US009900703B2

(12) United States Patent
Kim et al.

(10) Patent No.: US 9,900,703 B2
(45) Date of Patent: Feb. 20, 2018

(54) SUSPENSION FOR HIGH POWER MICRO SPEAKER AND HIGH POWER MICRO SPEAKER HAVING THE SAME

(75) Inventors: Cheon Myeong Kim, Gyeongsangnam-do (KR); Kyu Dong Choi, Gyeongsangnam-do (KR); In Ho Jeong, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 574 days.

(21) Appl. No.: 13/592,940

(22) Filed: Aug. 23, 2012

(65) Prior Publication Data

US 2014/0056463 A1 Feb. 27, 2014

(51) Int. Cl.
*H04R 1/00* (2006.01)
*H04R 9/04* (2006.01)

(52) U.S. Cl.
CPC ..... *H04R 9/043* (2013.01); *H04R 9/047* (2013.01); *H04R 2499/11* (2013.01)

(58) Field of Classification Search
CPC ..... H04R 1/00
USPC ..... 381/396, 398
See application file for complete search history.

(56) References Cited

U.S. PATENT DOCUMENTS 5,490,422 A * 2/1996 Tabota ..... G01P 15/0922 73/514.34
6,853,734 B2 * 2/2005 Sahyoun ..... H04R 1/06 381/403
2006/0188126 A1 * 8/2006 Andersen et al. ..... 381/396
2011/0051985 A1 * 3/2011 Hwang et al. ..... 381/396
2011/0268297 A1 * 11/2011 Lee ..... H04R 19/02 381/191
2011/0274309 A1 * 11/2011 Doh et al. ..... 381/398
2013/0156237 A1 6/2013 Kim
2014/0169593 A1 6/2014 Kwon et al.

FOREIGN PATENT DOCUMENTS

CN 202035136 U 11/2011
CN 102598709 A 7/2012
CN 103563397 A 2/2014
KR 10-0930537 12/2009
KR 10-2011-0022656 3/2011
KR 10-1187510 10/2012
WO 2011/027995 3/2011

OTHER PUBLICATIONS

Extended European Search Report for EP 12006042.1 (Jun. 28, 2013).

* cited by examiner

*Primary Examiner* — Duc Nguyen
*Assistant Examiner* — Phan Le
(74) *Attorney, Agent, or Firm* — Murphy, Bilak & Homiller, PLLC

(57) ABSTRACT

The present invention relates to a suspension structure for a high power micro speaker and, more particularly, to a shape of a suspension which ensures a lightweight of the suspension as well as high reliability and a conductive pattern which applies electric signals. The present invention provides a suspension for a high power micro speaker that includes an outer peripheral portion, a central portion and a connection portion, is provided with a conductive pattern, and is formed in a rectangular shape, wherein land portions for use in soldering or welding lead-in wires of a voice coil are formed on long connection portions disposed on long sides.

6 Claims, 10 Drawing Sheets

SUSPENSION FOR HIGH POWER MICRO SPEAKER AND HIGH POWER MICRO SPEAKER HAVING THE SAME

TECHNICAL FIELD

The present invention relates to a suspension structure for a high power micro speaker and, more particularly, to a shape of a suspension which ensures a lightweight of the suspension as well as high reliability and a conductive pattern which applies electric signals.

BACKGROUND ART

Sound reproduction techniques of mobile multimedia have been improved with the development of mobile communication technologies, as a result of which high performance, high sound quality and high power are required of a micro speaker.

In most cases, a conventional micro speaker does not use a special suspension to ensure a lightweight of a diaphragm and connects a lead wire of a voice coil to the diaphragm via bonding to apply external electric signals to the voice coil. Therefore, unbalanced vibration is often generated due to the absence of the suspension, and the lead wire of the coil is often down in high power due to a tensile force, which makes it difficult for the micro speaker to be applied to high power.

In order to solve the foregoing problem, there has been developed a micro speaker using a suspension provided with a conductive pattern for transmitting electric signals. In the case of the micro speaker using the suspension, an increase in weight of the diaphragm, which results from the use of the suspension, leads to a decrease in sound pressure of the micro speaker. In addition, cracks may occur in the conductive pattern in high power, causing a defect.

FIG. 1 is a view showing a shape of a voice coil and a lead wire used in a conventional suspension type micro speaker, FIG. 2 is a view showing fabrication of a rectangular coil of FIG. 1, and FIG. 3 is a view showing a shape of a suspension used in the conventional micro speaker. As illustrated in FIG. 2, a circular voice coil 10 is changed to a rectangular voice coil 20 using a jig 30. Here, lead wires 22 and 24 of the voice coil 20 are positioned on the short side of the rectangular shape. Referring to FIG. 3, a suspension 40 includes an outer peripheral portion 42, an inner peripheral portion 46, and a connection portion 44 connecting the outer peripheral portion 42 to the inner peripheral portion 46. A conductive pattern 50 as well as land portions 60 for use in soldering or bonding the lead wires 22 and 24 of the voice coil 20 are formed on the surface of the suspension 40. In the conventional suspension 40, the land portions 60 for use in soldering or bonding the lead wires 22 and 24 of the voice coil 20 are formed on the connection portion 44 disposed on the short side adjacent to the positions of the lead wires 22 and 24 of the coil.

FIG. 4 is a view showing stress distribution of each portion that is generated in the event of vibration of the conventional suspension.

Here, it can be seen that a significant surface tension occurs inside the short connection portion 44 disposed on the short side of the suspension 40, as a result of which cracks may easily occur in the conductive pattern 50 formed on the surface of the suspension 40.

DISCLOSURE OF THE INVENTION

An object of the present invention is to provide a suspension structure which can resist high power in a micro speaker.

Another object of the present invention is to provide a conductive pattern of a suspension for a micro speaker which can transmit electric signals even when cracks occur in some part of the suspension.

A further object of the present invention is to provide a shape of a suspension and a conductive pattern which can minimize a further decrease in sound pressure caused by the use of the suspension.

A still further object of the present invention is to provide a suspension which does not interrupt a smooth vertical movement of a diaphragm.

According to an aspect of the present invention, there is provided a suspension for a high power micro speaker that includes an outer peripheral portion, a central portion and a connection portion, is provided with a conductive pattern, and is formed in a rectangular shape, wherein land portions for use in soldering or welding lead-in wires of a voice coil are formed on long connection portions disposed on long sides.

In some embodiments, protective films for protecting the conductive suspension are attached to the outer peripheral portion, the central portion and the connection portion, and some parts of the protective films attached to the long connection portions disposed on the long sides are removed.

In some embodiments, protective film for protecting the conductive suspension is attached to the outer peripheral portion, the central portion and the connection portion, and the protective film on the long connection portions disposed on the long sides is removed.

In some embodiments, protective film for protecting the conductive suspension is attached to the outer peripheral portion, the central portion and the connection portion, and some part of the protective film on the central portion is removed.

In some embodiments, protective film for protecting the conductive suspension is attached to the outer peripheral portion, the central portion and the connection portion, and some parts of the protective film on short connection portions disposed on short sides are removed.

According to another aspect of the present invention, there is provided a high power micro speaker which includes a conductive suspension described above, and a voice coil, lead-in wires of which corresponding in direction to land portions of the suspension.

According to a further aspect of the present invention, there is provided a high power micro speaker which includes a conductive suspension described above, and a voice coil, lead-in wires of which being drawn out from opposite diagonal positions and shaped in a right-angle direction.

In the conductive suspension for high power provided by the present invention, the land portions for use in soldering or welding the lead-in wires of the voice coil are disposed on the long connection portions positioned in a short direction, which prevents cracks from occurring in the conductive pattern in the event of high power vibration, and the land portions are symmetrically positioned, which prevents unbalanced vibration.

Moreover, in the conductive suspension provided by the present invention, some parts of the protective films on the long connection portions positioned in a short direction are removed to reduce the intensity of vertical vibration, which facilitates low sound vibration when the speaker is mounted.

Additionally, in the conductive suspension provided by the present invention, some part of the protective film on the central portion of the suspension is removed to improve a sound pressure.

BEST MODE FOR CARRYING OUT THE INVENTION

Hereinafter, preferred embodiments of the present invention will be described in detail with reference to the accompanying drawings.

Figure 1:
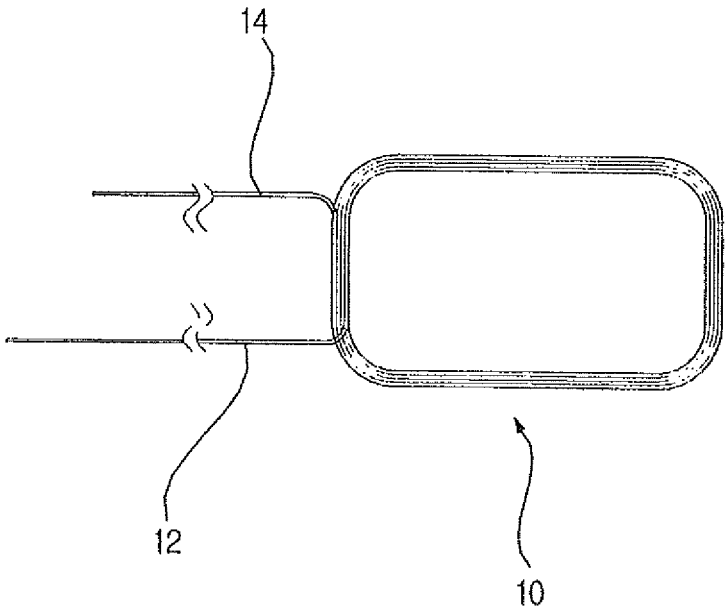
FIG. 1 is a view showing a shape of a voice coil and a lead wire used in a conventional micro speaker having a suspension.
Figure 2:
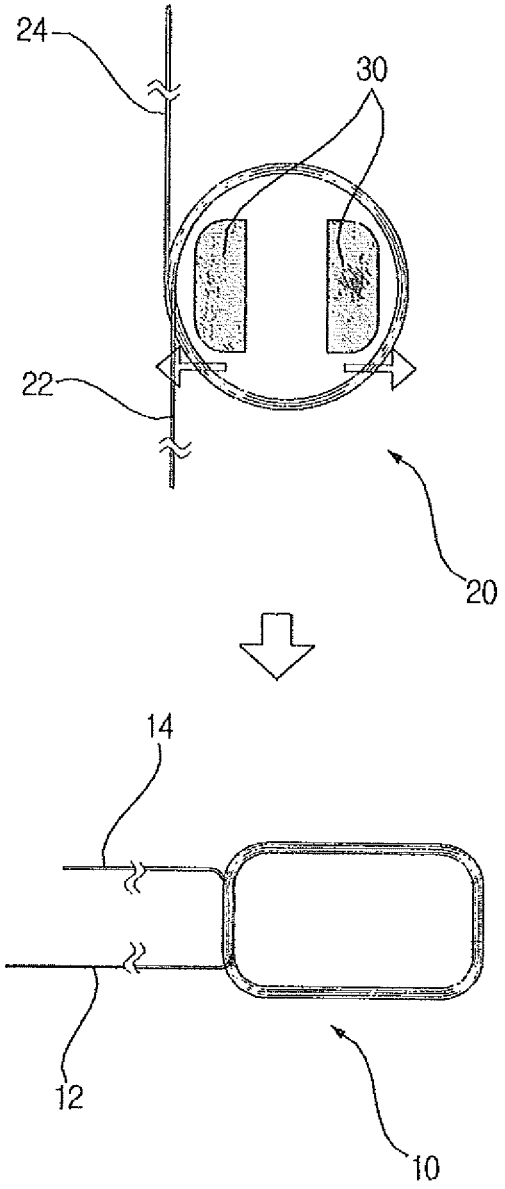
FIG. 2 is a view showing fabrication of a rectangular coil of FIG. 1.
Figure 3:
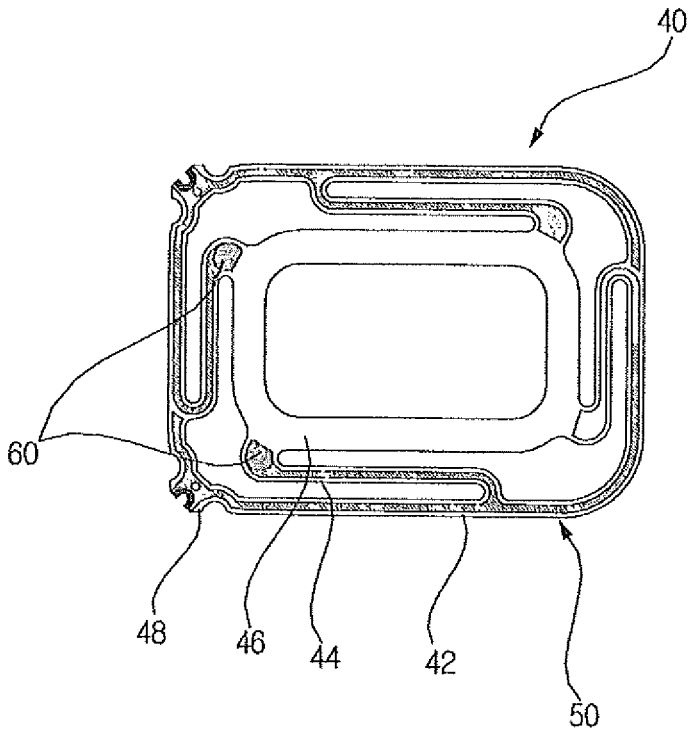
FIG. 3 is a view showing the suspension used in the conventional micro speaker.
Figure 4:
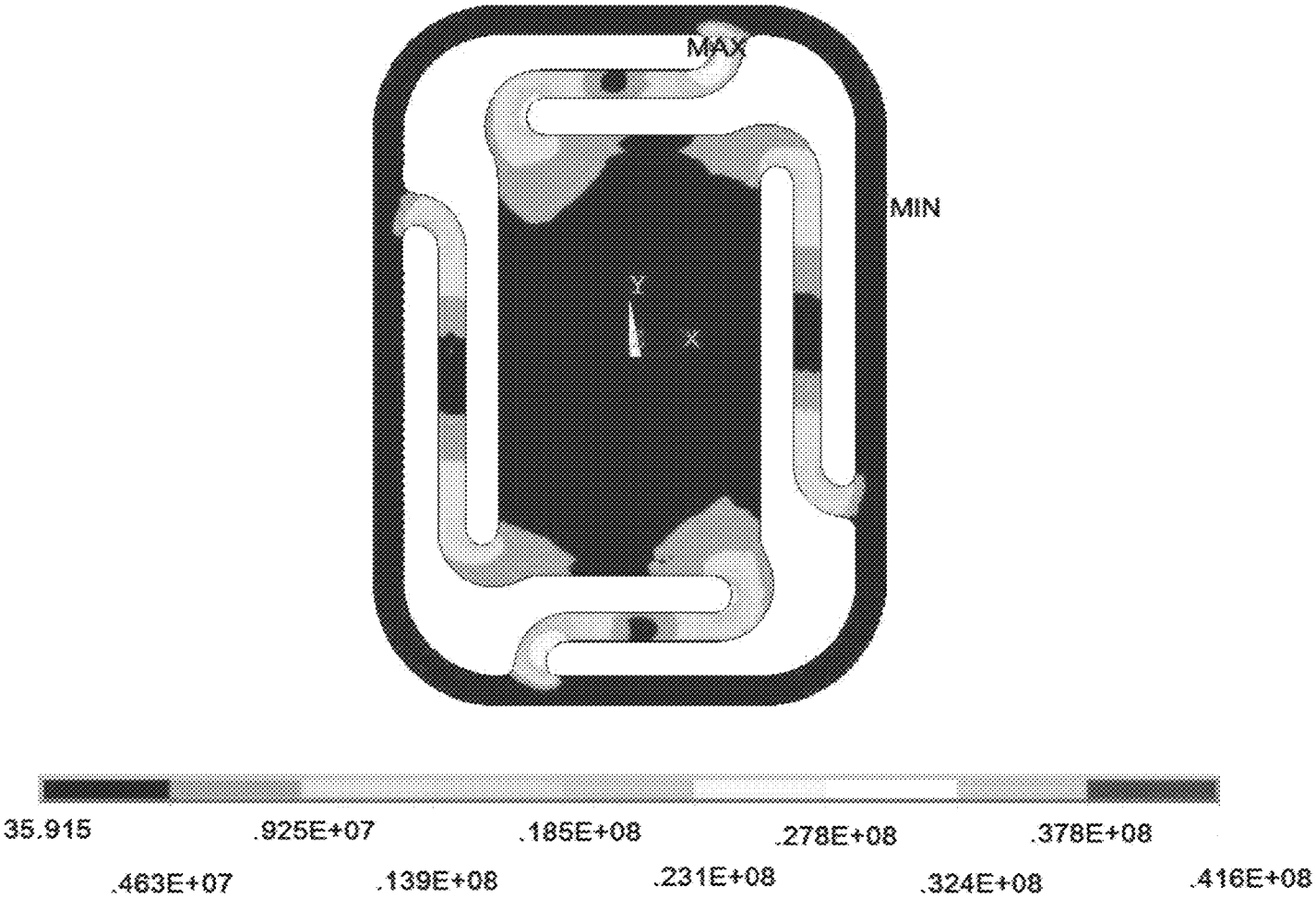
FIG. 4 is a view showing stress distribution of each portion that is generated in the event of vibration of the conventional suspension.
Figure 5:
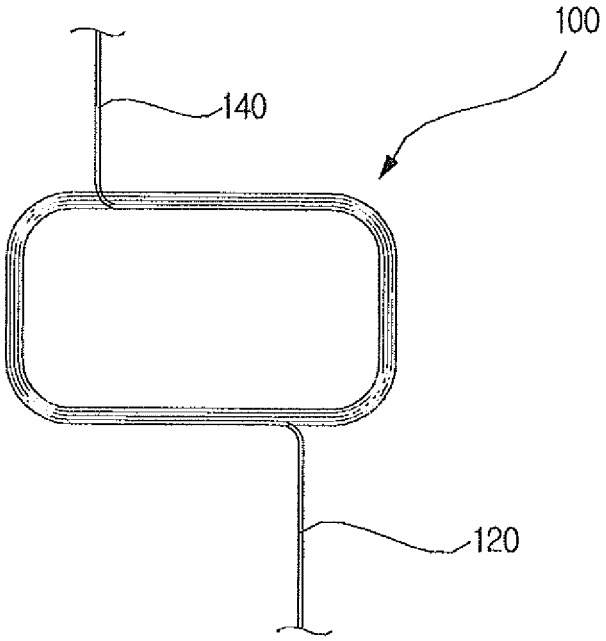
FIG. 5 is a view showing a voice coil lead-in wire structure provided in a micro speaker according to a first embodiment of the present invention.

FIG. 5 is a view showing a voice coil lead-in wire structure provided in a high power micro speaker according to a first embodiment of the present invention. A voice coil 100 provided in the high power micro speaker according to the first embodiment of the present invention is formed in a rectangular shape like a conventional rectangular coil 10. However, the voice coil 100 provided in the high power micro speaker of the present invention and the voice coil 10 of the prior art have a difference in drawing-out directions of lead wires 120 and 140. The lead wires 120 and 140 of the voice coil 100 are not disposed on the same side of the rectangular shape side by side but drawn out from opposite diagonal sides. Preferably, the lead wires 120 and 140 are drawn out from ends of two longer sides among the four sides of the rectangle. These positions are adjacent to the positions of land portions of the suspension for the high power micro speaker according to the first embodiment of the present invention and are easy to weld or solder the lead wires 120 and 140 to the land portions, as will be discussed later. Meanwhile, after drawn out, the lead wires 120 and 140 of the voice coil 100 are shaped in a right-angle direction according to a shape of a connection portion of the suspension discussed later.

Figure 6:
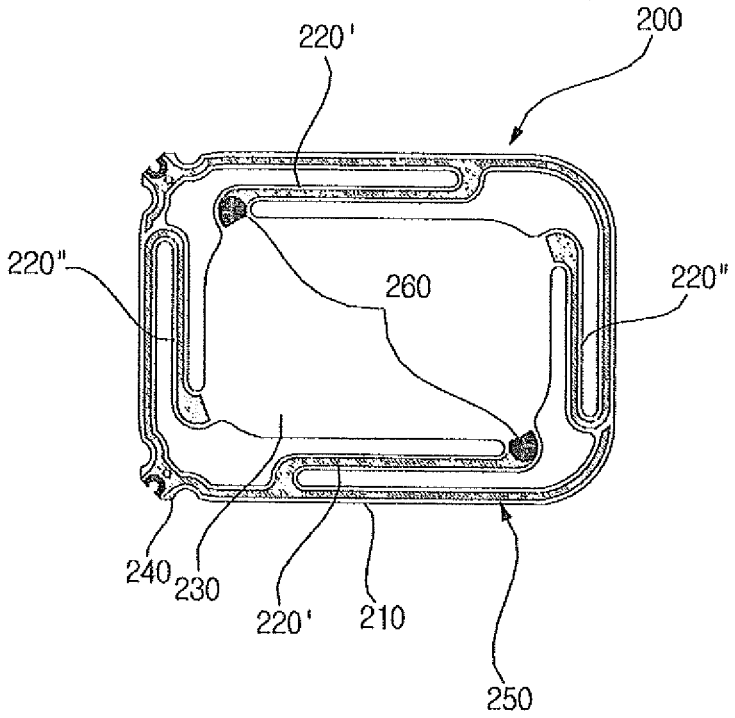
FIG. 6 is a view showing positions of land portions of a suspension for the high power micro speaker according to the first embodiment of the present invention.

FIG. 6 is a view showing the suspension for the high power micro speaker according to the first embodiment of the present invention. A suspension 200 according to the first embodiment of the present invention includes an outer peripheral portion 210, connection portions 220' and 220" and a central portion 230, and also includes a terminal portion 240 for providing electric connection to an external terminal on one side. In addition, a conductive pattern 250 is formed on the suspension 200, in particular, on the outer peripheral portion 210, the terminal portion 240 on one side of the outer peripheral portion 210, and the connection portions 220' and 220". Meanwhile, the suspension 200 is formed in a rectangular shape, and land portions 260 for use in welding or soldering the lead wires 120 and 140 of the voice coil 100 are disposed on the connection portions 220' (longer sides of the rectangle) connecting the outer peripheral portion 210 to the central portion 230 among the connection portions 220' and 220". That is, the land portions 260 for use in welding or soldering the lead wires 120 and 140 are symmetrically positioned in a diagonal direction. The land portions 200 for use in welding or soldering the lead wires 120 and 140 of the voice coil 100 are disposed on the longer connection portions 220' among the connection portions 220' and 220", which prevents cracks from occurring in the conductive pattern 250 in high power, and the land portions 260 are symmetrically positioned, which prevents unbalanced vibration.

Figure 7:
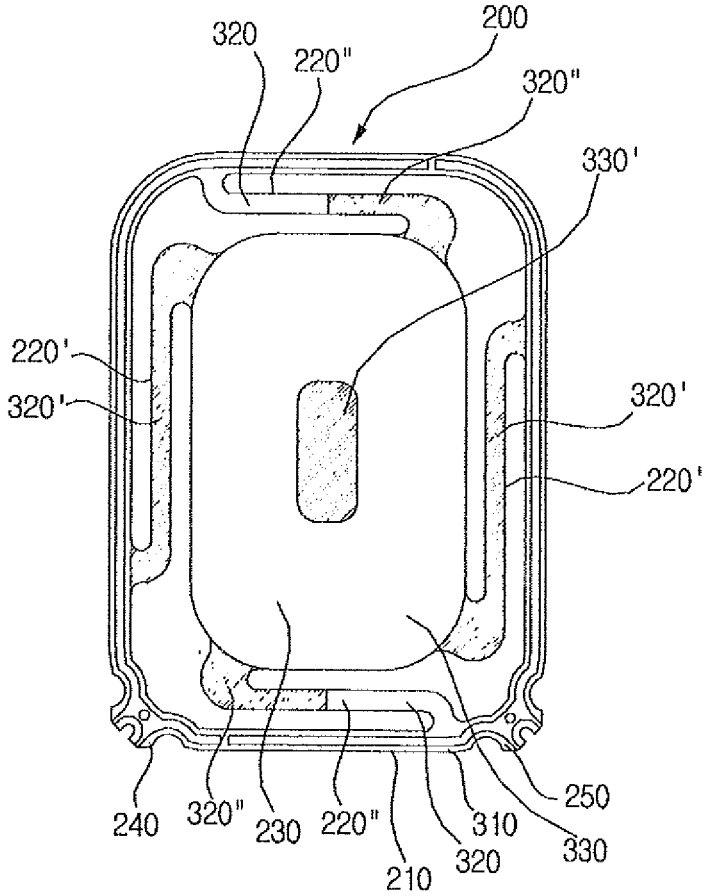
FIG. 7 is a view showing the position, from which a protective film is removed, on the suspension for the high power micro speaker according to the first embodiment of the present invention.

FIG. 7 is a view showing the position, from which a protective film is removed, on the suspension for the high power micro speaker according to the first embodiment of the present invention. Protective films 310, 320 and 330 for protecting the conductive pattern 250 formed on the suspension 200 as well as the suspension 200 itself are attached to the top and bottom of the suspension for the high power micro speaker according to one embodiment of the present invention. The protective films 310, 320 and 330 are attached to the outer peripheral portion 210, the connection portions 220' and 220", and the central portion 230 of the suspension 200. Some sections 320', 320" and 330' of the protective films 310, 320 and 330 attached to the top of the suspension 200 (where the voice coil 100 is not attached) are removed to improve sound characteristics of the high power micro speaker. The sections 320', 320" and 330', from which the protective films are removed, are designated as shaded sections in FIG. 7.

In particular, the protective films 320 attached to the longer connection portions 220' disposed on the long sides among the connection portions 220' and 220" of the suspension 200 are partially or wholly removed (320') to reduce the intensity of vertical vibration, which facilitates low sound vibration when the speaker is mounted.

Additionally, the protective films 320 attached to the connection portions 220" disposed on the short sides among the connection portions 220' and 220" of the suspension 200 are partially removed (320") to reduce the intensity of vertical vibration, which facilitates low sound vibration when the speaker is mounted.

Moreover, the central portion of the protective film 330 attached to the central portion 230 of the suspension 200 is partially removed (330') to reduce a weight of the entire suspension 200, which improves a sound pressure.

Figure 8:
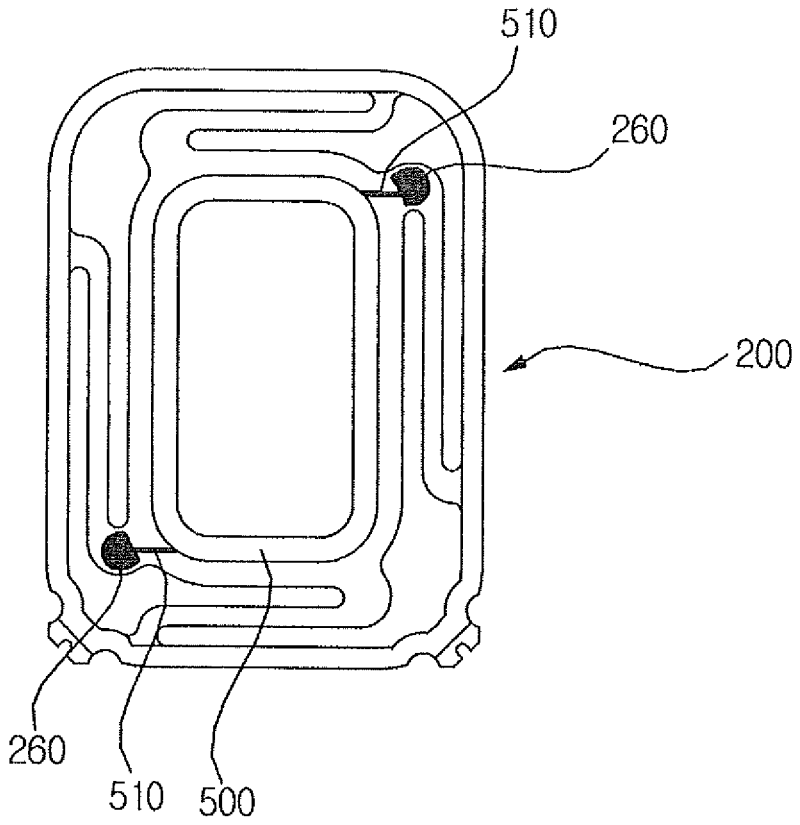
FIGS. 8 to 10 are views showing a high power micro speaker according to a second embodiment of the present invention.
Figure 9:
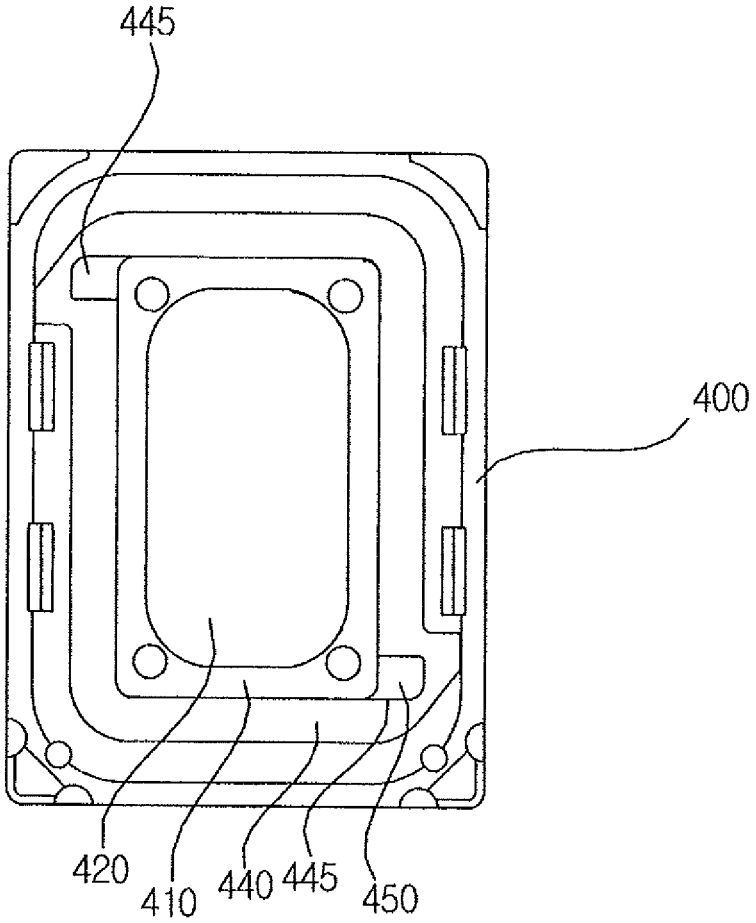
Figure 10:
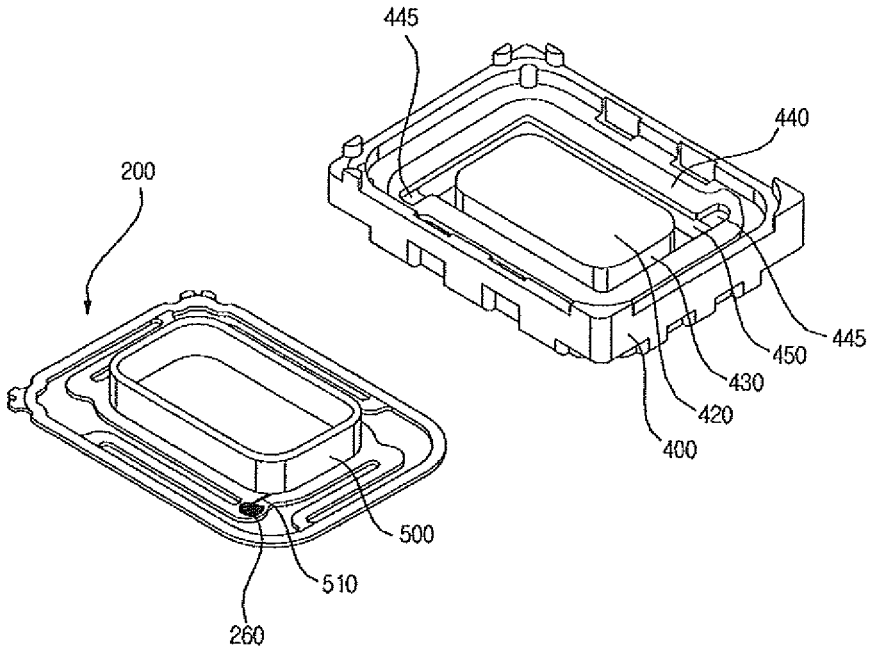

FIGS. 8 to 10 are views showing a micro speaker according to a second embodiment of the present invention. In the micro speaker according to the second embodiment of the present invention, some parts of a top plate corresponding to solder land portions are removed to prevent a suspension from colliding against the top surface of the top plate and thus getting damaged due to its excess vibration caused by high power vibration.

What is claimed is:

1. A suspension for a high power micro speaker that includes an outer peripheral portion, a central portion and a connection portion, is provided with a conductive pattern, and is formed in a rectangular shape, wherein land portions for use in soldering or welding lead-in wires of a voicecoil are formed on long connection portions disposed on long sides, wherein the suspension further comprises a protective film for protecting the conductive pattern being attached to the outer peripheral portion, the central portion and the connection portion, wherein some part of the protective film attached to the central portion is removed so as to reduce weight of the suspension, whereas the part of the protective film attached to the outer peripheral portion and connection portion remains so as to prevent the conductive pattern from being damaged.

2. The suspension of claim 1, wherein some parts of the protective film attached to the long connection portions disposed on the long sides are removed.

3. The suspension of claim 1, wherein the protective film attached to the long connection portions disposed on the long sides is removed.

4. The suspension of claim 1, wherein some parts of the protective films attached to short connection portions disposed on short sides are removed.

5. A high power micro speaker, comprising:

a conductive suspension as recited in claim 1; and a voice coil, lead-in wires of which corresponding in direction to land portions of the suspension.

6. A high power micro speaker, comprising:

a conductive suspension as recited in claim 1; and a voice coil, lead-in wires of which being drawn out from opposite diagonal positions and shaped in a right-angle direction.

* * * * *